United States Patent [19]

Fox et al.

[11] 3,952,656

[45] Apr. 27, 1976

[54] DEVICE AND PROCESS

[75] Inventors: Richard Fox, Rosanna; David Gilbert Hay, Balaclava; Ronald John Herniman, North Balwyn, all of Australia

[73] Assignee: Imperial Chemical Industries of Australia and New Zealand Limited, Melbourne, Australia

[22] Filed: Sept. 5, 1973

[21] Appl. No.: 394,479

Related U.S. Application Data

[63] Continuation of Ser. No. 181,161, Sept. 16, 1971, abandoned.

[30] Foreign Application Priority Data

Sept. 21, 1970 Australia ..... 2604/70
Apr. 13, 1971 Australia ..... 4561/71

[52] U.S. Cl. ..... 102/30
[51] Int. Cl.[2] ..... F42B 3/20
[58] Field of Search ..... 102/22–24, 102/30

[56] References Cited

UNITED STATES PATENTS

| | | | |
|---|---|---|---|
| 2,007,568 | 7/1935 | Heitzman | 102/30 |
| 2,296,504 | 9/1942 | Crater | 102/30 |
| 2,632,390 | 3/1953 | Madill | 102/30 |
| 2,916,995 | 12/1959 | Douglass et al. | 102/30 |
| 3,151,556 | 10/1964 | Karpovich | 102/30 X |
| 3,236,180 | 2/1966 | Towle | 102/22 |
| 3,264,992 | 8/1966 | Beck | 102/30 |
| 3,648,614 | 3/1972 | Berthmann et al. | 102/23 |

*Primary Examiner*—Verlin R. Pendegrass
*Attorney, Agent, or Firm*—Cushman, Darby & Cushman

[57] ABSTRACT

A stemming device for holes which device comprises at least one layer of a resilient material capable of forming a seal in conjunction with the wall of a hole, the seal being characterized in that it prevents, minimizes or substantially retards the flow of flowable, pourable or pumpable material from the hole. The device is used to stem a hole by positioning the same in the hole in a manner such that said stemming device forms a seal in conjunction with the wall of the hole capable of preventing, minimizing or substantially retarding the flow of flowable, pourable or pumpable material from the hole.

3 Claims, 10 Drawing Figures

DEVICE AND PROCESS

Figure 1:
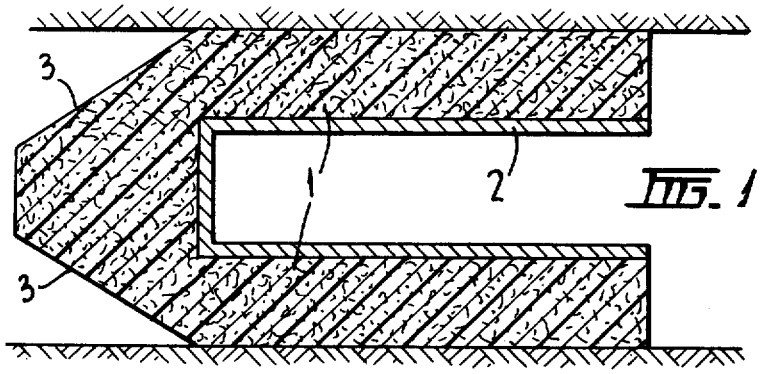

This is a continuation of application Ser. No. 181,161 filed Sept. 16, 1971 and now abandoned.

This invention relates to stemming or sealing devices and to a method of stemming holes; in particular it relates to a method of stemming "up-holes." By "up-holes"we mean those holes of the kind in which the toe of the hole is located higher in relation to the work face than the collar of the hole.

In underground mining operations it is frequently desirable to blast away rock from the walls and ceiling of the workings. This entails drilling holes in the work face at inclinations above the horizontal — i.e., in an upward direction — and hereinafter such holes will be referred to as up-holes. Commonly the blasting agent used in such holes is ammonium nitrate impregnated with fuel oil, for example 'ANFO,' which is pneumatically injected into the holes so that it forms a compact mass which stays in the holes even if they are vertical up-holes.

However, ammonium nitrate/fuel oil blasting agents are not waterproof nor are they very powerful in relation to other explosives. The so-called slurry explosives are, in general more waterproof and more powerful than the ammonium nitrate/fuel oil compositions, and for these reasons it is desirable to use them in blasting operations in up-holes. By slurry explosive we mean, any explosive composition which is capable of being flowed, pumped or poured. Most commonly slurry explosives are aqueous compositions comprising ammonium nitrate, a gelling agent an organic fuel and a metal fuel. A typical composition is for example:

| | |
|---|---|
| Ammonium nitrate | 683 parts by weight |
| Aluminum powder | 100 parts by weight |
| Guar gum | 5 parts by weight |
| Zinc chromate | 2 parts by weight |
| Sugar | 50 parts by weight |
| Sodium nitrate | 20 parts by weight |
| Water | 140 parts by weight |

Despite the advantages which could accrue from the use of slurry explosives, their use in up-holes has so far been restricted because of difficulties encountered in maintaining them in position in an up-hole because of their inherent flow properties. Attempts have been made to use conventional stemming materials such as for example wooden plugs, cement blocks, sand or clay inserts to stem the collar of an up-hole containing slurry explosive compositions. Whilst the use of such stemming materials has been in part successful, their use has suffered from the disadvantage that the aqueous slurry has tended to escape from the hole under the influence of gravity despite the use of such stemming materials. For example when wooden plugs were used it was found to be very difficult to seal the collar of the hole completely since the borehole was usually rough on its surface and the inelastic nature of the plug precluded the formation of a liquid proof seal between the plug and the borehole surface. Again the use of cement blocks was unsatisfactory. A preformed cement block suffered from disadvantages similar to those found when a wooden plug was used, and when attempts were made to cast a cement block in the hole, it was found that even with so-called quick setting cements the cement mixture tended to leave the wall of the hole and furthermore the time of setting was sufficiently long to allow some of the explosive to escape prior to the setting of the cement. It was also found that cement cast in situ in the up-hole often tended to shrink on setting, thus leaving a space between the block and the wall of the borehole through which the explosive composition could pass. In the instance where a sand or clay stemming composition was used, it was found that the explosive composition percolated through the stemming material.

Further, when the borehole was not completely filled with slurry explosive but rather the slurry column terminated some distance from the collar of the hole it was found to be difficult to locate a suitable stemming device in the borehole.

We have now found new stemming devices for holes and a method of stemming a borehole wherein the desired compositions contained therein are retained in the hole. Our stemming devices and methods are applicable to all boreholes. Thus our devices and methods may be used in holes drilled in a downward direction from the work face and thus in addition prevent the ingress of unwanted matter, for example water, into the hole. However, they are particularly useful in stemming up-holes. Our method is of general application to retain the contents of a hole in a desired position. Not only is it useful for applications relating to blasting explosives, but it can be applied to procedures involving the containment of any flowable, pourable or pumpable material in a confined space having an open end. Thus for example grouting materials such as cement mixtures in their flowable state can be retained in a position in upholes by means of our stemming device and process until the grouting has aquired sufficient rigidity to become self-supporting.

Accordingly we provide a stemming device for holes which device comprises at least one layer of a resilient material capable of forming a seal in conjunction with the wall of a hole said seal being characterized in that it prevents, minimizes or substantially retards the flow of flowable, pourable or pumpable material from the hole.

The resilient material from which our device may be fabricated may comprise for example, natural rubber, synthetic rubbers, cork or plastics materials. The plastics materials include polymers such as, for example, polyethylene, polypropylene, polymethylpentene-1, polyvinylchloride, polyesters, polysiloxanes, polyamides, polyacrylamides, polybutadiene, polyacrylonitrile, polyurethanes, and copolymers thereof. Other suitable materials, although less preferred as polystyrene, urea-formaldehyde resins and phenol-formaldehyde resins. If desired the resilient material may contain other additives well known in the art for example fillers, extenders, stabilizers, antioxidants, plasticizers, softening agents, flame retardants, colouring materials and the like.

The stemming materials may be prefabricated into shapes designed to fit into appropriate sizes and shapes of holes. Thus they may be in solid blocks, in sheets of various thicknesses or in the form of threaded screws. Alternatively they may be in the form of foamed shapes. Such foams may conveniently be of a size larger than the space that they have to fill in the hole, so that they may be constrained prior to insertion into the hole and then after insertion and removal of the constraining means allowed to expand so as to form a tight seal against the wall of the hole. It is also convenient to form foamed materials in situ by foaming plastics materials in the hole in the conventional manner. A typical example of forming a foamed stemming material in situ is the preparation of a polyurethane foam which may be injected into the hole as a semifluid mass which subsequently sets in the hole to form a foamed stemming material. Alternatively the stemming material may be made from two materials which react one with the other with the evolution of a gas to form a solid. The two liquids are contained separately in a capsule. Immediately prior to insertion of the capsule into the hole the membrane separating the materials in the capsule is ruptured and the ingredients are allowed to mix. The capsule is inserted in the hole, the reaction product causes the capsule to burst and the resultant reaction product on leaving the capsule forms a stemming material in the hole.

A preferred stemming, tamping or hole sealing device is a prefabricated shaped object comprising resilient material, as hereinbefore described, and at least one reinforcing member. Such a hole sealing device may have a reinforcing member or a series of reinforcing members located internally within the shaped resilient material or alternatively such members may be attached to the exterior surface of the resilient material. Yet again such members may be located partially within the shaped resilient material and extend beyond its exterior surface. By reinforcing member we mean a member which is less resilient than the resilient material from which the shaped object is made. The shape of the reinforcing member or members is not narrowly critical but the shape chosen for any particular device should be such that the reinforcing member enhances the strength of a seal made between the device and the wall of a hole into which the device has been placed. The reinforcing material may be for example in the form of rigid rods, tubes or strips which may be solid or hollow and made for example, from metal, plastics material or rubber; they may also take the form of rubber 0-rings or be screws made from hardened rubber or semirigid plastics materials. It is further preferred that the stemming, tamping or hole sealing device be provided with means for example a one way valve, through which gas, for example air, may pass. Such a means facilitates the insertion of the device into a hole which is closed at one end. Such means allows the gas in the hole to escape from the hole instead of being compressed as the device is inserted into the hole. Our preferred device comprising at least one reinforcing member is suitable for processes hereinbefore described but wherein the device did not comprise a reinforcing member. The inclusion of one or more reinforcing members in our device is advantageous in that it facilitates the insertion of the device into the desired position in a hole. Thus for example when the resilient material is a foamed plastics material and the reinforcing member is a rigid hollow tube, the device may be urged into a hole by applying a force to the rigid hollow tube in the direction in which it is desired to propel the device. Furthermore the presence of a reinforcing member in the device assists in providing an enhanced seal between the wall of the hole and the device by providing areas of differing resilience in the device. Typically there may be mentioned a device comprising a resilient plug surrounding a rigid core. We have observed with devices of this type when such a device is inserted in one direction into a hole of smaller dimensions that the unconstrained device and then a force is applied to said device which tends to move said device in a direction opposite to the direction of insertion that the more resilient portions of the device roll up on themselves to form a seal having great stability between the device and the wall of the hole.

The reinforced devices of this embodiment may, as hereinbefore described for devices having no reinforcement be prefabricated into shapes designed to fit into appropriate sizes and shapes of holes and preferably being larger than the space that they have to fill in the hole. Thus such devices may be of regular shape for example in the form of a cube, parallelpiped, pyramid, frustrum of a pyramid, polyhedron, cone, ellipsoid, cylinder or truncated cylinder. Less preferred shapes are a sphere or spheroid. Alternatively there may be of irregular shape designed to occupy the desired space for a particular purpose. It is often convenient to provide our devices with a tapered or pointed section, which may be regularly or irregularly shaped. Such a section is useful when it is the first part of the device to be urged into a hole and facilitates the positioning of the device. It is also convenient for some purposes to provide our device with a tapered section such that portion of the device, particularly that portion which is to be located nearest the collar or orifice of a hole, is wider than the remainder of the device. A further convenient form of our device is one in which the exterior surface is corrugated. Such a configuration provides a series of seals with the wall of a hole and is very convenient when used in conjunction with exterior located 0-rings as reinforcing members.

More than one stemming material may be used to form our device. Thus it may be convenient to use a sheet of material as a primary material in proximity to the contents of the hole, and then to have a further material, for example, a foamed plastics material, in the hole as a further stemming material. Alternatively it may be convenient to have a series of stemming materials, such as sheets or reinforced preformed foams attached to a common axis and to insert the assembly into the hole so as to form a series of seals with the wall of the hole. Such an assembly is advantageous in instances where the borehole is rough and the individual seals so formed are not completely effective against the flow of material from the hole, although the seals in combination are effective in preventing, minimizing or substantially retarding the flow of material from the hole.

Accordingly we also provide a process of stemming a hole which process comprises inserting into or forming in a hole at least one stemming device as hereinbefore described, in a manner such that said stemming device forms a seal in conjunction with the wall of said hole capable of preventing minimizing or substantially retarding the flow of flowable, pourable or pumpable material from said hole.

By the use of our stemming device holes may be charged with any flowable, pourable or pumpable composition, which may be for example a liquid or a mixture of liquids, solid material in divided form or a slurry of solid and liquid materials, and the charge contained or substantially contained within the hole by stemming the charged hole with at least one of our stemming devices.

Accordingly we provide a process of charging a hole with a flowable, pourable or pumpable composition which process comprises in combination loading a hole with said flowable, pourable or pumpable composition and stemming said hole with at least one stemming device as hereinbefore described in a manner such that said stemming device forms a seal in conjunction with the wall of said hole capable of preventing, minimizing or substantially retarding the flow of said compositions from said hole.

In particular our stemming device is useful in mining operations and may be used in the preparation of boreholes containing explosive compositions.

Accordingly we provide a process of charging a hole with at least one explosive composition which process comprises in combination loading a hole with said explosive commposition and stemming said hole with at least one stemming device as hereinbefore described in a manner such that said stemming device forms a seal in conjunction with the wall of said hole capable of preventing, minimizing or substanttially retarding the flow of said explosive composition from said hole. Such a process is particularly suited for loading up-holes such as are encountered in underground mining operations.

This process is applicable to holes containing any type of explosive material and more than one type of explosive material may be present in the hole. Thus for example it may be desirable, because of the nature of the material being blasted, to have explosive materials of differing compositions present in the hole. Such compositions could be for example a series of ammonium nitrate slurry compositions of varying explosive power; alternatively the compositions could comprise a slurry explosive and an ammonium nitrate-fuel oil composition or an explosive based on nitroglycerine. The amount of stemming material used and its position in the hole will depend on the conditions under which it is being used and the type of blasting result being desired. Thus for example the hole may be filled substantially with an explosive composition and the stemming material may occupy only a minor proportion of the hole and be situated substantially in the vicinity of the collar of the hole. Alternatively, because of the nature of the blasting operation being performed, it may be desirable to have the explosive composition located at some distance from the work face. Under such conditions the stemming material may be used to retain the explosive composition in the desired position. Again it may be desirable to locate the explosive charge in more than one position in the hole. Under these circumstances the stemming material may be used as a spacing material between the separated charges in addition to acting as a stemming material in the vicinity of the collar of the hole. It is sometimes found in drilling a hole that cracks or fissures are intersected during the drilling operation and that water flows from these cracks or fissures into the borehole. The presence of such water during a blasting operation is undesirable and our stemming material may be utilized to minimize or prevent such water flow. Thus for example it may be found that such a wet fissure occurs in the vicinity of the toe of the hole and it is convenient to staunch the water flow by locating our stemming material in the vicinity of the toe of the hole and the fissure prior to loading the hole with the desired explosive material. Further stemming material would then be used in the hole as described above for locating the explosive material and stemming the hole. In charging a hole with an explosive composition it is usually convenient to position the charge in the hole and then stem the hole with our stemming material. However it is sometimes convenient to partially stem the hole prior to the introduction of the explosive material and then to complete the stemming of the hole subsequent to the completion of the introduction of the explosive material into the hole. Thus for example a hole may be stemmed in part by a stemming material, for example a foamed plastic material, situated in the vicinity of the collar of the hole and extending some distance into the hole. A loading hose may be inserted through the stemming material by means of an orifice in the stemming material and of sufficient size to allow the passage of the loading hose through it. A fluid explosive composition, such as an explosive slurry, may then be pumped into the hole through the hose. After the explosive composition has been charged into the hole, the loading hose may be withdrawn and the orifice sealed with further stemming material which may be the same as or different from the original stemming material. Stemming materials used in our process of charging holes with explosive compositions may be the resilient materials described above. We have found plastics materials to be very useful for this purpose particularly foamed plastics materials such as foamed polyurethane compositions. Such foamed plastics materials may be preformed and inserted into the hole as a plug or alternatively they may be formed in situ in the hole.

Explosive compositions in holes which have been charged with explosive compositions by the procedure described above may be detonated using conventional primers and detonating devices. Thus for example the priming charge, with detonating means attached, may be seated in the leading face of the stemming material situated in the vicinity of the collar of the hole. Alternatively the explosive composition may be primed at the toe of the hole or at one or more points along the explosive charge by inserting the primer, with detonating means attached, into the hole in the course of the charging operation. Yet again if there is more than one section of stemming material in the hole, primers and detonating means may be attached to any one of or all of these stemming materials. When the stemming material is in the form of a preformed object having an internal orifice it is sometimes convenient to locate and attach suitable primers and detonating devices within such an orifice. Such a procedure has application when explosive compositions are stemmed in a series of holes by means of preformed objects according to our invention and the compositions are then detonated by the well known techniques of delay firing. This procedure of locating primers and detonating devices ensures that they are held in position during the detonating sequence and thus the possibility of misfires is reduced. Detonation of the explosive compositions is obtained in the conventional manner.

Our stemming materials may also be used on construction sites where it is desired to confine building materials such as cement slurries in positions for a period of time. They are particularly useful where it is desirable to incorporate cement in the roof of a building or in the overhead portions of a tunnelling construction.

Accordingly we provide a process of construction which process comprises in combination charging a hole with a flowable, pourable or pumpable building material and stemming said hole with at least one stemming device as hereinbefore described in a manner such that said stemming device forms a seal in conjunction with the wall of said hole capable of preventing, minimizing or substantially retarding the flow of said building material from said hole. Such a process is particularly suited for charging up-holes.

Our stemming devices are also useful in that they may be used as a means of sealing and anchoring bolts, pins and the like into holes formed in solid surfaces. Thus for example they may be used to hold bolts in the rock roof of a tunnel or a mine or yet again they may be used to hold pins and hooks inserted in holes made in house walls, said pins and hooks being used to display ornaments, pictures and the like. For use as a sealing and anchoring device we have found it convenient for most purposes to use preformed shaped articles comprising a resilient foamed material such as foamed rubber or a plastic foam for example foamed polyethylene, polypropylene, polymethylpentene-1 or nylon. Where the hole to be sealed is small it is sometimes more convenient to use a resilient foam formed in situ in the hole. In the instance where a preformed shaped device is used it is convenient to choose a shape which approximates to the shape of the hole to be sealed. For example where a bolt or pin is to be held in a hole of circular cross section, it is convenient to use a preformed right cylinder as the sealing device. It is preferred to use preformed shaped devices of the reinforced type, particularly those devices comprising an internal reinforcing member.

Accordingly we provide a process of sealing and anchoring a supporting member in a hole formed in a solid surface which process comprises inserting into said hole an assembly comprising in combination at least one preformed shaped resilient stemming or sealing device as hereinbefore described and provided with a hollow reinforcing member extending internally and substantially axially along the longest dimension of said device, said reinforcing member being optionally threaded in part and being attached at one end to a plate or nut which may optionally be threaded and situated externally of said device and a threaded supporting member inserted into a backing plate situated externally of said device and then inserted into said hollow reinforcing member so as to be engageable with said threaded reinforcing member, plate or nut; engaging said supporting member in said threaded reinforcing member, plate or nut, so as to compress said sealing device and thereby forming a seal between the wall of said hole and said device sufficient to seal and anchor said supporting member in said hole.

The hollow reinforcing member is preferably made of metal and attached to the plate or nut by suitable means for example welding. Whilst the adhesion between the reinforcing member and the internal surface of the device is often quite adequate, it is sometimes advantageous to use a coating of adhesive between the reinforcing member and the device to improve the adhesion between them. The assembly should be inserted into the hole in a manner such that the threaded plate or nut is the component of the assembly closest to the toe of the hole prior to engaging the thread of the supporting member in the plate or nut. However sufficient space should be left between the toe of the hole and the plate or nut to enable the supporting member to be adequately threaded into the plate or nut without encountering the surface at the toe of the hole. The backing plate should be situated in the vicinity of the collar of the hole and preferably should be located external of the hole so that in part it can be made to touch and extend some distance along the surface into which the hole has been formed. This embodiment of our invention is advantageous in that it provides a means of anchoring supporting members in surfaces without embedding a part of such members in the surfaces as taught in the prior art. Anchoring costs are thereby reduced.

Our stemming materials may also be used for the purposes of safety particularly from the aspect of controlling fires or dust in mines. Thus the collar of a hole may be stemmed with our materials. The hole, in this case an up-hole, is filled with a fire extinguishing material such as water, sand or a solid chemical fire extinguishing material such as "Monnex" (Registered Trade Mark). In a time of a fire emergency, the stemming material — previously connected to a rupturing device — is dislodged and the fire extinguishing material is distributed over the fire.

Accordingly we provide a process of controlling a fire which process comprises in combination charging an up-hole with at least one fire extinguishing material, stemming said hole with at least one stemming device as hereinbefore described in a manner such that said stemming device forms a seal in conjunction with the wall of said hole capable of preventing, minimizing or substantially retarding the flow of said fire extinguishing material from said hole, rupturing and dislodging said stemming material and distributing said fire extinguishing material over and in the vicinity of a fire.

Our preferred stemming, tamping or hole sealing device comprising a shaped resilient material and at least one reinforcing member may, like its unreinforced counterpart, be used to stem, tamp or seal holes of various shapes and dimensions. Such a device may be used for example to seal boreholes containing explosive compositions. Such holes may be of various diameters for example holes of diameters in the range from ½ to 12 inches. Such a device is particularly useful in "upholes" of diameter in the range from 1 to 4 inches for example 2 inches. It is particularly useful since, because of its construction, it has the property of strengthening the seal between the device and the wall of the hole when a load, for example from a column of explosive material, is applied to it in a direction opposite to the direction of insertion of the device into the hole.

Accordingly we provide a process of stemming, tamping or sealing a hole which process comprises inserting into a hole at least one device comprising resilient material as hereinbefore described shaped so that its maximum transverse unconfined dimension is equal to or greater than the maximum transverse dimension of the hole to be stemmed, tamped or sealed and at least one reinforcing member as hereinbefore described said device being characterized in that when said device is moved in the direction opposite to the direction of insertion the resilient portion of said device is compressed upon itself to strengthen the seal between said device and the wall of said hole so as to counteract the movement of said device.

When the stemming device is in the form of a prefabricated shaped object having an orifice within the interior we have found that such an orifice, in addition to be useful for urging the device into the desired position or locating reinforcing members, is suitable as a repository for articles used in various processes. Thus for example such an orifice in the absence of a reinforcing member or in the presence of a hollow reinforcing member within it is useful in explosive applications for the location of detonating means for example explosive initiating charges such as pentolite and detonators. It will be appreciated that in the instance where the detonating means is located in a borehole containing explosive slurry there is the possibility that the slurry will contaminate the detonating means. By locating the items in the orifice of the stemming device such contamination is reduced substantially and usually eliminated.

Accordingly we provide in the known process of locating within a borehole detonating means suitable for the detonation of an explosive composition located within said borehole the improvement which comprises locating said detonating means within the interior of a prefabricated shaped stemming device as hereinbefore described situated in said borehole.

In another example reference may be made to the location of dust suppressants in the orifice of the stemming device. It has been common practice in mining operations to use various materials to suppress dust in the work area in the region of a blast hole after the explosive material has been detonated. Typical of dust suppressants in common use there may be mentioned water and materials in the form of gels, for example cellulose gels and sodium silicate gels. Hitherto such dust suppressants have been located at or in the proximity of the collar of a blast hole and when such holes are inclined upwardly it has been found difficult to locate such suppressants, usually in the form of a container or a package, in a suitable and stable position. We have now found that a very convenient way of locating such suppressants is to insert them in the orifice of our stemming devices.

Accordingly we provide in the known process of locating within a borehole dust suppressant means the improvement which comprises locating said dust suppressant means within the interior of a prefabricated shaped stemming device as hereinbefore described situated in said borehole.

So that our invention may be more clearly understood there is set out, in the accompanying drawings, sketches of typical embodiments of our stemming devices. It should be appreciated that these sketches are merely illustrative and are by no means limiting to our invention.

Figure 2:
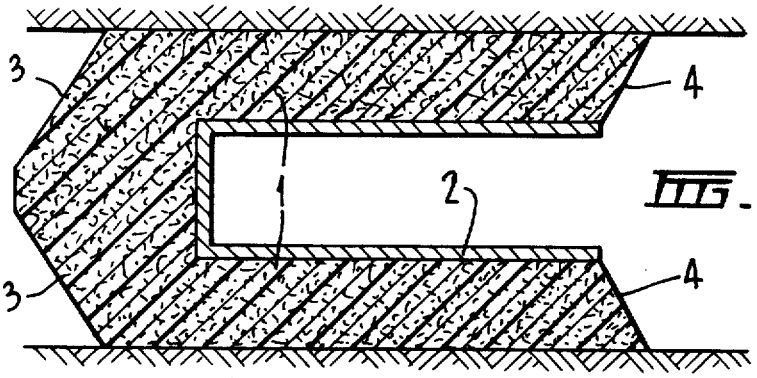
Figure 3:
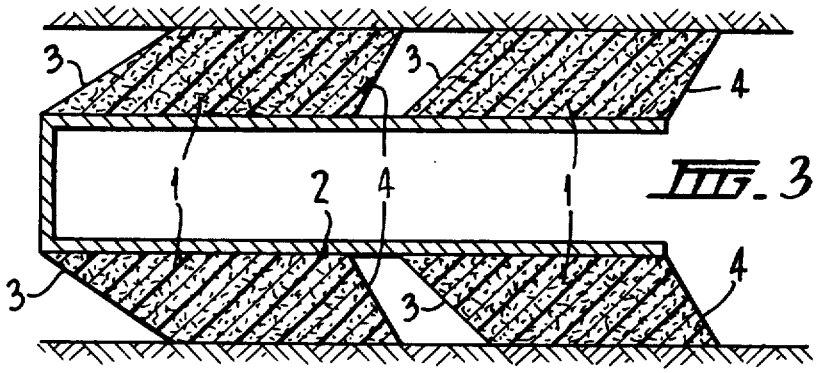
Figure 4:
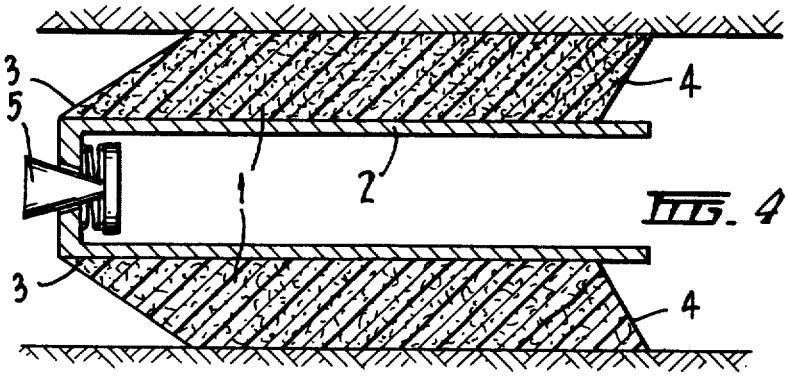
Figure 5:
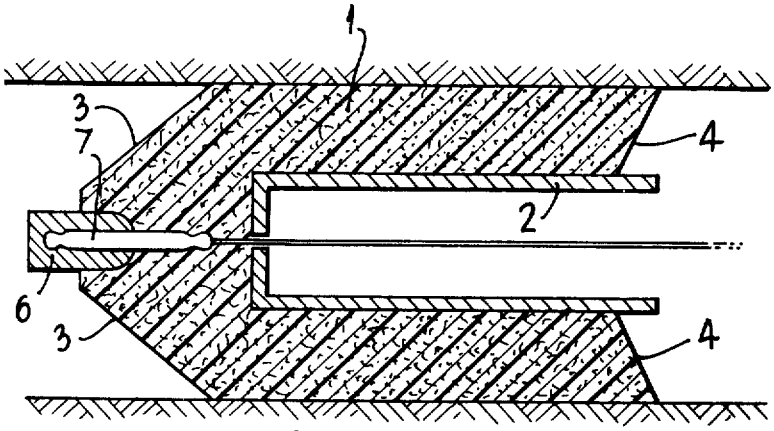
Figure 6:
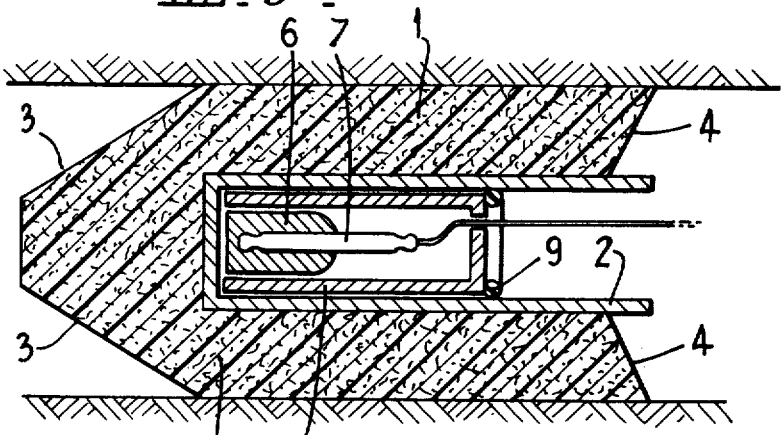
Figure 7:
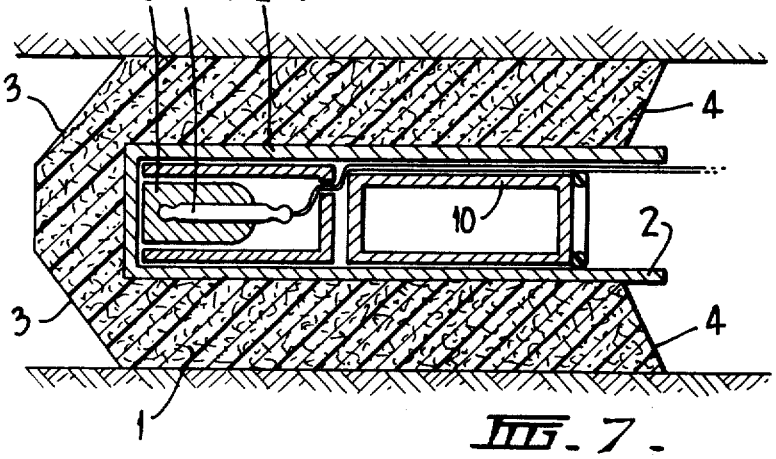
Figure 8:
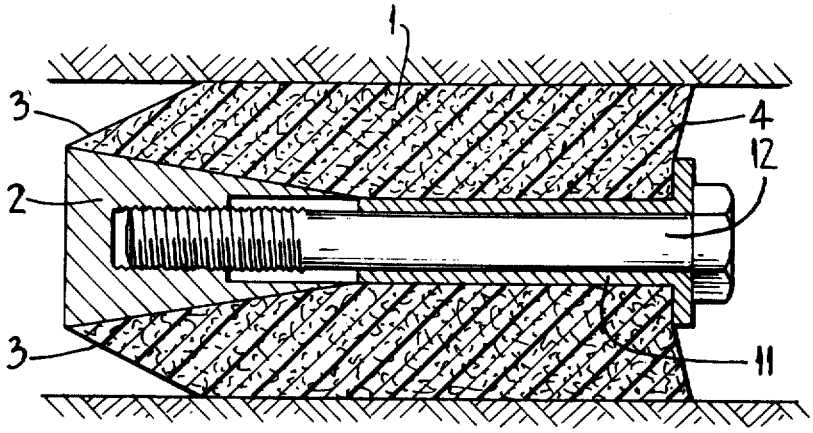
Figure 9:
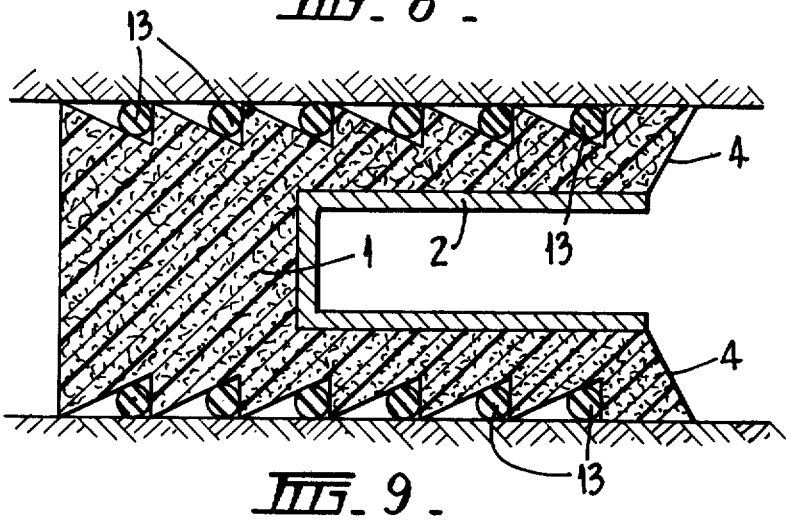
Figure 10:
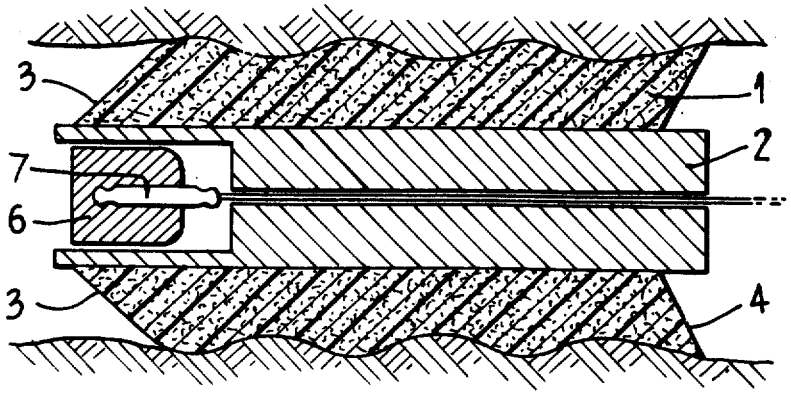

FIGS. 1–10 are of cross sections of our stemming devices and depict various general shapes thereof, as well as illustrating various embodiments of reinforcing members and in some instances the location of additional items useful in the practical application of the stemming devices for example the location of priming means, detonating means or dust suppressing means when the devices are to be used in explosives applications. For the purposes of identification the various areas and components illustrated have been numbered and where such areas or components fall into the same general category the same numbers are used in the various sketches. The numbers used refer as follows:

1 = Resilient foamed material forming the prefabricated shaped object.
2 = Reinforcing inserted member.
3 = Leading taper of shaped object.
4 = Trailing taper of shaped object.
5 = One way gas valve mechanism.
6 = Explosive initiating charge.
7 = Detonator.
8 = rigid priming charge container.
9 = Retaining O ring.
10 = Dust suppressant container.
11 = Backing collar.
12 = Bolt.
13 = Resilient O rings.

The following examples illustrate our invention but should not be construed as limiting.

EXAMPLE 1

This example demonstrates the use of a preformed polyurethane foam as a stemming device for a borehole. A cylinder 3½ inches in diameter of flexible polyurethane foam was prepared from a mixture of "Datocel" T56 (Registered Trade Mark of Imperial Chemical Industries Limited for a polyether triol) and "Suprasec" EN (Registered Trade Mark of Imperial Chemical Industries Limited for a mixture of the 2,4 and 2,6 isomers of tolylenediisocyanate). A 6 inch length of this cylinder was radially compressed and inserted into a 2 inch diameter smooth walled plastic tube simulating a borehole. The cylinder of foam was allowed to expand and formed a seal between itself and the tube. A force of 20 lb. was required to dislodge the foamed cylinder from the tube.

EXAMPLE 2

The general procedure of Example 1 was repeated but prior to inserting the polyurethane cylinder an amount of an ammonium nitrate explosive slurry was placed in the tube. The tube and its contents were suspended in a vertical position so that there was a column 4 feet in height of explosive slurry above the polyurethane cylinder. After 8 hours no explosive composition had leaked from the tube.

EXAMPLE 3

Equal parts of "Daltolac" DR 6202/18 (Registered Trade Mark of Imperial Chemical Industries Limited for a mixture of a polyether triol, a blowing agent, a catalyst and a surfactant and "Suprasec" DN (Registered Trade Mark of Imperial Chemical Industries Limited for a diisocyanatodiphenylmethane) were placed in a small vial. A cap was placed on the vial and the contents were mixed by shaking. The vial and its contents were placed in a 2-inch diameter plastic tube simulating a borehole. After a short reaction period the cap was blown off the vial as a result of the pressure developed in the vial. The foam so produced expanded into the tube and occupied a portion of the tube over its full diameter giving a good seal against the walls of the tube.

EXAMPLE 4

This example demonstrates the use of a reinforced preformed plastic foam as a sealing device for a borehole. A cylinder 3 inches in diameter of flexible polyurethane foam was prepared as described in Example 1 and then shaped in the form of a right circular cylinder of diameter 3 inches and height 4½ inches tapered at one end to a truncated cone section having a smaller diameter of ¾ inch and a cone height of 1½. Portion of the cylinder was removed so as to form an aperture the orifice of which was situated approximately centrally in the base of the cylinder. The aperture was in the shape of a hollow cylinder 3 inches in length and 1 inch in diameter. Into the aperture was inserted an aluminum tube 3 inches in length and 1¼ inch in diameter. One of the ends of the aluminum tube was hollow and this was situated at the base of the cylindrical section; the other end of the tube was closed and was glued to the polyurethane foam at the closed end of the aperture. The device was inserted into a bored cylindrical hole 2 inches in diameter and 12 inches in length which had been made in a section of an ore body and which was open at both ends. The insertion was made by applying force to the device by means of a push rod inserted into the aluminum tube. Force was then applied to the truncated conical section by means of an "Instron" (Registered Trade Mark) force testing machine and the device was slowly moved along the bored hole in a direction opposite to that of its insertion. A force of 100 lb. was required to dislodge the device from the bored hole. It was observed when the force was applied to the conical section, simulating the effect of a column of an explosive composition on the device, that the polyurethane in contact with the wall of the bore hole was distorted and rolled back on itself to form a strong seal between itself and the wall of the borehole.

EXAMPLE 5

The general procedure of Example 4 was repeated, but in the present example the depth of the orifice was increased to 4 inches and a hollow polystyrene tube 3 inches in length and 1¼ inch in diameter was used in place of the aluminium tube of Example 4. Portion of the base of the cylindrical section was removed to leave a concave truncated conical section extending from the base of the cylinder to the open end of the polystyrene tube. A force of 110 lb. was required to dislodge the device from the bored hole. As in Example 4 the polyurethane in contact with the wall of the bore hole rolled back on itself to form a strong seal as the dislodging force was applied.

EXAMPLE 6

A sealing device similar to that used in Example 5 was prepared, but the polyurethane of that example was replaced by a foamed polyvinylchloride composition and the polystyrene tube was replaced by a tube of unplasticized polyvinylchloride. Again a good seal between the polyvinyl chloride foam and the wall of the bored hole was obtained as force was applied to the device in the bored hole by the procedure of Example 4.

EXAMPLE 7

One end of the bored cylindrical hole described in Example 4 was closed off temporarily to atmosphere to simulate a borehole in a mine. A cylinder of natural rubber foam 3 inches in diameter and 5 inches in length reinforced centrally with a solid rod ⅔ inch in diameter and 5¼ inches in length was inserted into the bored hole through its open end. Whilst the insertion procedure continued it became progressively more difficult to position the device. The temporary closing device was then removed from the bored hole and the device dislodged from the hold by the method of Example 4. The rubber foam formed an excellent seal with the wall of the bored hole.

EXAMPLE 8

The general procedure of Example 7 was repeated but the solid rod was replaced by a hollow metal tube having two open ends and of similar dimensions to the solid rod. The device was inserted easily into the bored hole. The rubber foam formed an excellent seal with the wall of the bored hole.

EXAMPLE 9

A sealing device similar to that of Example 5 was prepared, but the polyurethane of that example was replaced by a foamed polyethylene composition. The foam was prepared from a polymer available commercially from Imperial Chemical Industries of Australia and New Zealand Limited under the Trade Name of "Alkathene" WJG 117. The device formed an excellent seal with the wall of the bored hole when tested under the conditions described in Example 4.

EXAMPLE 10

A sealing device similar to that of Example 5 was prepared but the polyurethane of that example was replaced by a foamed copolymer composition. The copolymer used in preparing the device was a copolymer of polyethylene and polyvinyl acetate containing about 28% w/w of polyvinyl acetate and available from Imperial Chemical Industries Limited under the Trade Name of EVA copolymer 2805. A good seal was formed with the wall of the bored hole when the device was tested under the conditions described in Example 4.

EXAMPLE 11

A solid block of polybutadiene having a circular base of 4 inches diameter and a height of 6 inches was fabricated and shaped so that the exterior surface was corrugated. In general appearance the block was similar to a series of frustrated cones with the smaller bases 3¼ inches in diameter of the frustrums joined to the larger bases 4 inches in diameter of the frustrums. Into the series of corrugations so formed were placed soft rubber O-rings of cross section ½ inch which were suitable as sealing media. The shaped block contained an orifice and polystyrene reinforcing member similar to those described in Example 5; the base was also flared as in Example 5. The device so formed was inserted into a bored cylindrical hole 4 inches in diameter and 12 inches in length which had been made in a section of an ore body and which was open at both ends. When force was applied to the device in a direction opposite to that of its insertion the O-rings expanded and formed an excellent seal between the device and the wall of the bored hole.

EXAMPLE 12

Into the roof of a mine there was bored a hole 80 feet long and 2 inches in diameter. A detonating charge provided with detonating means was placed in position in the vicinity of the toe of the borehole. An amount of an ammonium nitrate slurry explosive composition was placed in the borehole so that the explosive composition filled the borehold for a distance of 65 feet measured from the toe of the hole. A sealing device as described in Example 5 was then inserted in the hole and moved upwards until it was in close proximity to the explosive composition. The assembly was inspected 24 hours after placing the sealing device in position and it was observed that no explosive composition had leaked past the sealing device during that time. The explosive composition was then detonated successfully by conventional means.

EXAMPLE 13

The general procedure of Example 12 was repeated except that in the present example the detonating charge, and its detonating means attached to the leading face of the sealing device, was placed in the borehole after the explosive composition had been placed in position and was situated between the column of explosive slurry and the sealing device. Successful detonation of the explosive composition was achieved.

EXAMPLE 14

The general procedure of Example 12 was repeated except that the ammonium nitrate slurry of that example was replaced by an ammonium nitrate fuel oil explosive composition containing 6% w/w of fuel oil. The explosive composition was detonated successfully by conventional means.

EXAMPLE 15

The general procedure of Example 12 was repeated except that in the present example the detonating charge and the detonating means were placed within the tube in the orifice of the stemming device before the stemming device was inserted into the borehole. Successful detonation of the explosive composition was achieved.

EXAMPLE 16

The general procedure of Example 12 was repeated. In addition there was placed in the borehole, between the sealing device and the collar of the hole, a second sealing device of dimensions similar to that of the sealing device of Example 5 except that it had a height of 24 inches, the depth of the orifice was 20 inches and the polystyrene tube was 19 inches in length. Into the polystyrene tube there was placed a sealed polyethylene bag containing water. The bag of water filled the polystyrene tube substantially completely and was maintained in position in the tube by means of strips of adhesive tape attached to the bag and the body of the second sealing device. The bag of water remained in position in the 24 hour period between assembly and the successful detonation of the explosive composition and after detonation the water acted as a dust suppressant in the proximity of the blast.

EXAMPLE 17

A cylindrical borehole ¼ inches in diameter and 9 inches in length was drilled vertically upwards into a rock face. From a block of foamed polyethylene there was fabricated an article in the form of a right circular cylinder of diameter 1½ inches and height 6 inches tapered at one end to a truncated cone section having a smaller diameter of 1 inches and a cone height of ¼ inch. Portion of the base of the cylindrical section was removed to leave a concave conical section extending from the base of the cylinder. The height of the cone was ¼ inch. Part of the foam was removed to form a cylindrical hole open at both ends and 13/16 inch in diameter. This hole was situated centrally in and extended for the full length of the longest dimension of the article. Glue was applied to the surface of the hole so formed and there was then inserted into the glued hole a hollow steel tube 7/8 inch in external diameter. The steel tube compressed the foam and acted as a reinforced member. It extended from the base of the article and protruded slightly beyond the truncated conical section. A threaded metal plate 1⅛inches in diameter was welded to the protruded portion so that the thread of the plate was parallel to and formed an extension of the bore of the steel tube and positioned so that it was in contact with the 1 inch diameter truncated conical section. The device so prepared was inserted into the hole in the rock face so that the lower end of the device was located inside the borehole and 3 inches from the collar of the hole. A ⅜ inches bolt 9 inches in length was passed through a hole in a metal backing plate 2 inches in diameter and the plate was positioned so that it covered the collar of the borehole and was in contact with the surface of the rock face surrounding it. The bolt was then inserted into the steel tube and tightened by screwing it into the threaded portion of the metal plate. As the bolt was tightened the plate in contact with the truncated conical section compressed the device and caused the lower portion of the foamed article to roll up on itself thereby forming a seal between the wall of the borehole and the device. When the device was in its fully compressed state a load of 100 lb was attached to the bolt head. After 24 hours there was no sign that the bolt had moved from its position prior to the application of the load.

We claim:

1. A stemming device for holes which device comprises a generally cylindrical object formed of a solidified material selected from a group consisting of natural rubber, synthetic rubbers and plastic materials having a generally circular top and bottom and a lateral surface corrugated to form a series of frustrated cones, a series of O-rings placed in the corrugations of the lateral surface, said device being capable of forming a seal in conjunction with the wall of a hole and being characterized in that it prevents, minimizes or substantially retards the flow of flowable, pourable or pumpable material from said hole when said device is moved in the direction opposite that of insertion whereby the O-rings expand and form a seal between the device and the wall of said hole.

2. A stemming device for effectively sealing holes comprising:

a resilient member having front, lateral and rear surfaces and comprised of a resistant solidified foam material, reinforcing means attached to said member for reinforcing said member, wherein the lateral surface is in contact with the wall of said hole and said rear surface is provided with an inwardly and rearwardly tapered trailing surface defining a flexible edge which remains in contact with the wall of said hole and adapted to flex toward the wall of said hole when a force is applied to the front surface of said device from within the hole which would tend to move said device rearwardly out of said hole in the direction of said rear surface, wherein said resilient member comprises an outer shell and wherein said reinforcing means comprises a hollow core secured within said outer shell, wherein said hollow core is in the form of a tube having front and rear ends, said front end being closed and said rear end being open and extending through to said rear surface thereby defining an opening within the interior of said device, and wherein said front end of said tube forms a portion of said front surface of said device, wherein said front end is provided with a one-way valve adapted to allow gas within the hole head of said device to be discharged through said device and out of the hole.

3. A stemming device for effectively sealing holes comprising:

a resilient member having front, lateral and rear surfaces and comprised of a resistant solidified foam material, reinforcing means attached to said member for reinforcing said member, wherein the lateral surface is in contact with the wall of said hole and said rear surface is provided with an inwardly and rearwardly tapered trailing surface defining a flexible edge which remains in contact with the wall of said hole and adapted to flex toward the wall of said hole when a force is applieed to the front surface of said device from within the hole which would tend to move said device rearwardly out of said hole in the direction of said rear surface, wherein said resilient member comprises an outer shell and wherein said reinforcing means comprises a hollow core secured within said outer shell, wherein said hollow core is in the form of a tube having front and rear ends, said front end being closed and said rear end being open and extending through to said rear surface thereby defining an opening within the interior of said device, and wherein said lateral surface which is corrugated so as to form a series of frustrated cones, a series of O-rings placed in said corrugations formed in the lateral surface of said outer shell whereby the O-rings form the seal between said device and the wall of said hole.

* * * * *